US006042516A

United States Patent [19]

Norton

[11] Patent Number: 6,042,516

[45] Date of Patent: Mar. 28, 2000

[54] EXERCISE APPARATUS

[76] Inventor: David A. Norton, 4910 W. Linebaugh, Tampa, Fla. 33624

[21] Appl. No.: 09/226,592

[22] Filed: Jan. 6, 1999

[51] Int. Cl.[7] ..... A63B 22/00

[52] U.S. Cl. ..... 482/54; 482/70; 482/71

[58] Field of Search ..... 482/51, 52, 54, 482/66, 69–72

[56] References Cited

U.S. PATENT DOCUMENTS

| | | | |
|---|---|---|---|
| D. 335,905 | 5/1993 | Cutter et al. | D21/191 |
| D. 351,435 | 10/1994 | Peterson et al. | D21/191 |
| 4,529,194 | 7/1985 | Haaheim | 482/70 |
| 4,618,139 | 10/1986 | Haaheim | 482/70 |
| 4,728,102 | 3/1988 | Pauls | 482/70 |
| 5,000,442 | 3/1991 | Dalebout | 482/70 |
| 5,203,751 | 4/1993 | Chang | 482/70 |
| 5,387,168 | 2/1995 | Bostic | 482/70 |
| 5,529,554 | 6/1996 | Eschenbach | 482/70 |
| 5,533,952 | 7/1996 | Schaber | 482/70 |
| 5,595,556 | 1/1997 | Dalebout et al. | 482/54 |
| 5,762,584 | 6/1998 | Daniels | 482/75 |
| 5,792,029 | 8/1998 | Gordon | 482/70 |
| 5,848,954 | 12/1998 | Stearns et al. | 482/70 |

*Primary Examiner*—Glenn E. Richmon
*Attorney, Agent, or Firm*—David Kiewit

[57] ABSTRACT

Apparatus that can be added to an existing ski treadmill provides resistance to a forward, as well as a rearward motion of an exerciser's arm. The apparatus includes a transverse beam attached to a body supporting post that is part of the treadmill. Longitudinal arms are hinged to the ends of this beam and swing away from their normal operating positions to allow an exerciser to mount or dismount from the apparatus. A closed rope loop having an indented portion is formed by connecting the two handgrips of a conventional ski treadmill with another piece of rope that engages, in sequence, a first pulley at the rear end of a first of the longitudinal arms, a second pulley near a hinge connecting that arm to the transverse beam, a third pulley at the other end of the beam, and a fourth pulley at the rear end of the second longitudinal arm.

9 Claims, 3 Drawing Sheets

EXERCISE APPARATUS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

An improved exercise machine simulative of cross-country skiing is provided by the invention.

2. Background Information

Ski treadmills, exercise machines that allow a user to simulate the motions involved in cross-country skiing, have been popular for many years. Perhaps the best known machines of this sort are made by the NordicTrack Corporation of Chaska, Minn. Examples of the variety of machines made by that firm, or for apparent use with their equipment, can be found in the patent art and include:

U.S. Pat. No. 5,533,952, to Shaber, who uses a handgrip with multiple anchor points in order to vary the muscles being exercised.

U.S. Pat. No. 5,387,168, to Bostic, describes adding a waist belt to a NordicTrack ski treadmill.

U.S. Pat. No. 4,728,102, to Pauls, shows a load indicator used with this sort of apparatus.

U.S. Des. Pat. Nos. 351,435 and 335,908 show two cosmetic designs for a ski treadmill.

U.S. Pat. No. 5,762,584 shows an electrically controlled variable resistance load for a skiing simulator.

Other art in the area includes:

U.S. Pat. No. 5,595,556, to Dalebout et al., which shows a treadmill having pivoting handles. The apparatus provides nearly constant resistance to both hand and foot motions regardless of whether the hand or foot is moving forwardly or rearwardly.

U.S. Pat. No. 5,203,751, to Chang, which shows a cross-country skiing simulator providing arm and leg resistance in both forward and rearward direction.

Haalheim, in U.S. Pat. Nos. 4,618,139 and 4,529,194, shows cross-country skiing treadmills providing arm exercise in both directions of motion. The machine shown in U.S. Pat. No. 4,618,139 has poles pivotally mounted to the base. The machine shown in U.S. Pat. No. 4,529,194 does not appear to be collapsible for storage, because of the tracks along which the pole carriages slide. Moreover, if some sort of lubrication were used on the pole carriage tracks, it would be likely to rub off the tracks onto the user's clothing.

BRIEF SUMMARY OF THE INVENTION

The invention provides an improvement to a ski treadmill exercise machine that simulates cross-country skiing, the machine comprising a pair of foot trolleys arranged for back and forth motion along a track or a pair of parallel tracks; an upstanding post adjacent a front end of the tracks, the post commonly having a rearward facing body support affixed to an upper end thereof. and a pair of handgrips, each of the handgrips attached by flexible attachment means, such as a rope or cable, to a resistance generating means, such as a rotating braked spool, disposed forwardly of the post, the resistance generating means providing a resistance when either handgrip is pulled rearwardly by an exerciser. The invention adds to this machine apparatus for providing a resistance to a forward pull as well as to a rearward one. This additional apparatus preferably comprises a pair of generally horizontal longitudinal arms disposed above and on either side of the tracks, wherein a forward end of each arm is attached to the post and a rear end of each arm extends rearwardly along the tracks further than the most rearward position that would be attained by an exerciser's arm or hand. This preferred apparatus further comprises three or more pulleys, wherein at least one of the pulleys is adjacent the post and wherein a respective one of the pulleys is disposed adjacent the rearward end of each of the longitudinal arms. This preferred apparatus further comprises an extended cable portion connected between the free ends of the two spooled cables, the extended cable portion engaging each of the pulleys sequentially along its length.

In a preferred embodiment, the apparatus comprises a transverse beam attached to the post and extending laterally outward beyond the two tracks, the transverse beam hingedly connected at each of its two ends to a respective one of the longitudinal arms; the preferred embodiment further comprising four pulleys, one at each rearward end of a respective longitudinal arm and one adjacent each of the two hinged connections between the transverse beam and a respective one of the longitudinal arms. Thus, in the preferred embodiment, the extended cable portion runs from the free end of a first spooled rope to the pulley at the rear end of a first of the longitudinal arms, thence along the longitudinal arm to the pulley adjacent the connection between the first longitudinal arm and a first end of the transverse beam, thence along the transverse beam to the pulley adjacent the connection between the second end of the transverse beam and the second longitudinal arm, thence along the second longitudinal arm to the pulley at the rear end of that arm and thence to the free end of the second spooled rope.

One of the features of a preferred embodiment of the invention is the provision of apparatus and method for adapting an existing ski treadmill that provides resistance to a rearward pull by an exerciser's arm so that the treadmill also provides resistance to a forward pull of the exerciser's arm.

It is an additional feature of an embodiment of the invention to provide exercise apparatus resisting both a forward and a backward motion of the swinging arms of an exerciser who swings his or her arms forwardly and backwardly while standing on or adjacent the apparatus.

Yet an additional feature of some embodiments of the invention is the provision a ski treadmill offering resistance to both a forward and a rearward motion of an exerciser's arm, the apparatus configured to allow the exerciser to approach and mount the treadmill from one side thereof.

Another feature of some embodiments of the invention is the provision of a ski treadmill offering resistance to both a forward and a rearward motion of an exerciser's arm, the apparatus configured so that no exposed lubricated surfaces are adjacent the exerciser's body.

Although it is believed that the foregoing recital of features and advantages may be of use to one who is skilled in the art and who wishes to learn how to practice the invention, it will be recognized that the foregoing recital is not intended to list all of the features and advantages, Moreover, it may be noted that various embodiments of the invention may provide various combinations of the hereinbefore recited features and advantages of the invention, and that less than all of the recited features and advantages may be provided by some embodiments.

DETAILED DESCRIPTION OF A PREFERRED EMBODIMENT OF THE INVENTION

Figure 1:
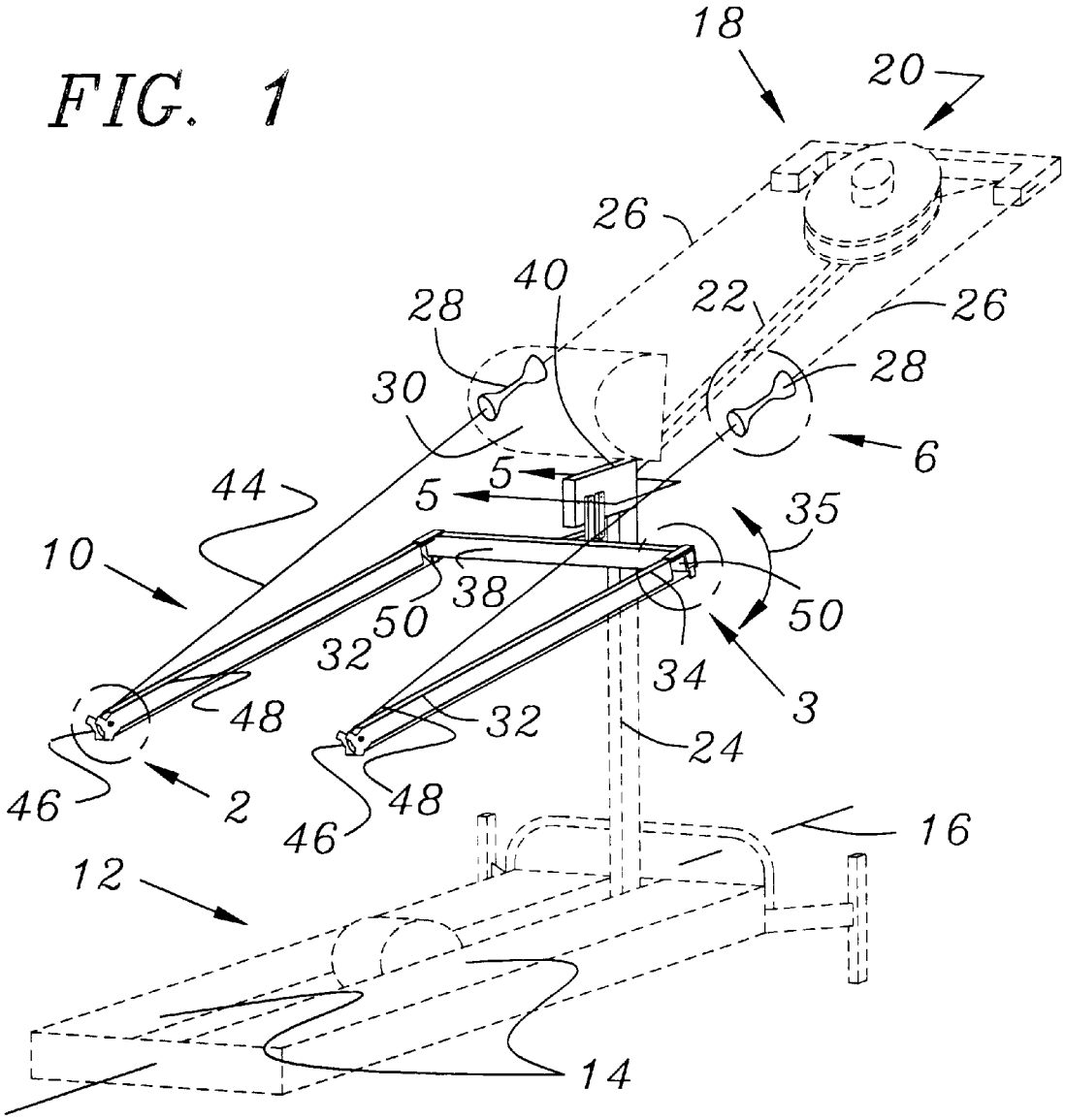
FIG. 1 is an elevational view of apparatus of the invention.

Preferred apparatus of the invention 10 is depicted in FIG. 1 attached to a well known cross-country skiing-simulative exercise device 12 of the sort manufactured by NordicTrack Corporation of Chaska, Minn. As is known in the art, such ski treadmills provide various means (such as foot trolleys (not shown)) engaged by an exerciser's feet and moved back and forth on respective tracks 14 disposed parallel to and on either side of a longitudinal axis 16 of the machine to simulate motion of cross-country skis over snow. It is noted that the present invention is concerned with apparatus for providing enhanced arm exercise when using a ski treadmill, is compatible with various known arrangements for engaging the exerciser's feet, and is not limited to use with any particular one of them.

Skiing-simulative equipment 12 of interest comprises a means 18 for resisting a rearward pulling force imposed by either of the exerciser's arms. That is, when the exerciser moves his or right foot forward, a resistance to the simultaneous and coordinated rearward motion of the exerciser's left arm is provided by the equipment 12 to simulate pushing a ski pole against the snow. In the equipment 12 depicted in FIG. 1, the rearward pull resistance means 18 comprises a braked spool arrangement 20 supported at the forward end of a forward-extending member 22 that has its rear end attached near the top of an upstanding post 24 disposed adjacent a front end of the tracks 14. Spooled rope(s) associated with the spool arrangement 20 have handles 28 attached to ends thereof distal from the spool 20 and are arranged so that when either handle 28 is pulled rearwardly of the spool 20 against whatever resistance it imposes, the other handle 28 moves forwardly. It will be understood that although the flexible means linking the resistance generating means to the handgrips conventionally comprise two pieces of woven rope, other materials, such as twisted rope, monofilament line, wire rope, wire cable, etc., could be employed for this purpose. Moreover, although it is common to use two separate pieces of rope for attaching each of the respective handgrips to the resistance generating means, a single piece of rope could be employed for this purpose.

An additional feature of the equipment 12 is a user-support 30 attached adjacent the top of the post 24 and extending rearwardly therefrom. When the equipment 12 is used, the exerciser's lower abdomen rests against this support 30 so that the exerciser is restrained from accidentally propelling himself or herself forwardly off the equipment. That is, the upstanding post 24 and support pad 30 provide a means of defining and limiting the forwardmost position of an exerciser's body.

The new apparatus 10 adds to an existing skiing-simulative machine a capability of resisting arm motion in both the forward and rearward directions. Although the desired resistance to a forward arm motion is not simulative of cross-country skiing, it does offer the exerciser an opportunity to exercise upper body muscles that are not used in a rearward pulling action.

In a preferred embodiment depicted in FIG. 1, the apparatus of the invention 10 comprises a pair of longitudinal arms 32 extending rearwardly from the upstanding post 24. The forward end 34 of each of the longitudinal arms 32 is preferably hingedly connected to a respective end of a transverse beam 38 that extends laterally outward from the axis 16 far enough that an exerciser can comfortably stand between the two longitudinal arms 34 without bumping into either arm while exercising. The preferred hinged connection allows either longitudinal arm 34 to swing outward from the skiing-simulative equipment 12, as indicated by the double-headed arrow 35, so that an exerciser can conveniently mount or dismount the equipment by swinging an arm 34 outwardly and stepping onto whatever foot engaging means is provided on the tracks 14. Although this sort of hinged connection is not essential to providing the desired resistance to both forward and rearward arm motion, it does provide an easier and safer method of mounting and dismounting the equipment. If the exerciser had to dismount the equipment by stepping rearwardly while having one or both feet engaging a trolley configured for fore and aft motion, he or she might fall.

In a preferred embodiment, the transverse beam 38 is attached to the upstanding post 24 by a parallel arm connector 40 comprising a bias spring 42 acting to provide a generally rearwardly directed bias force to the transverse beam 38. This arrangement provides a more or less constant tension on the cable set 26, 44. Parallel links 45 are employed to ensure that the longitudinal arms 32 move horizontally, so as to keep the arms 32 at the same height relative to the user. In this arrangement the bias spring 42 is selected to be strong enough to exceed the force imposed by a forwardly directed pull of one of the user's hands.

Figure 2:
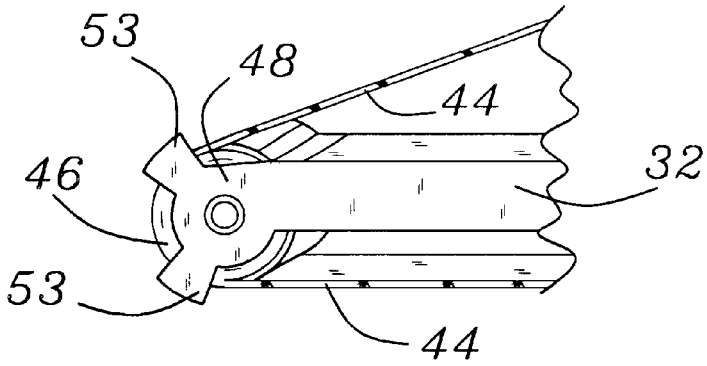
FIG. 2 is a detailed side elevation of a vertical pulley portion of the invention, the detailed portion shown by 2 in FIG. 1.
Figure 3:
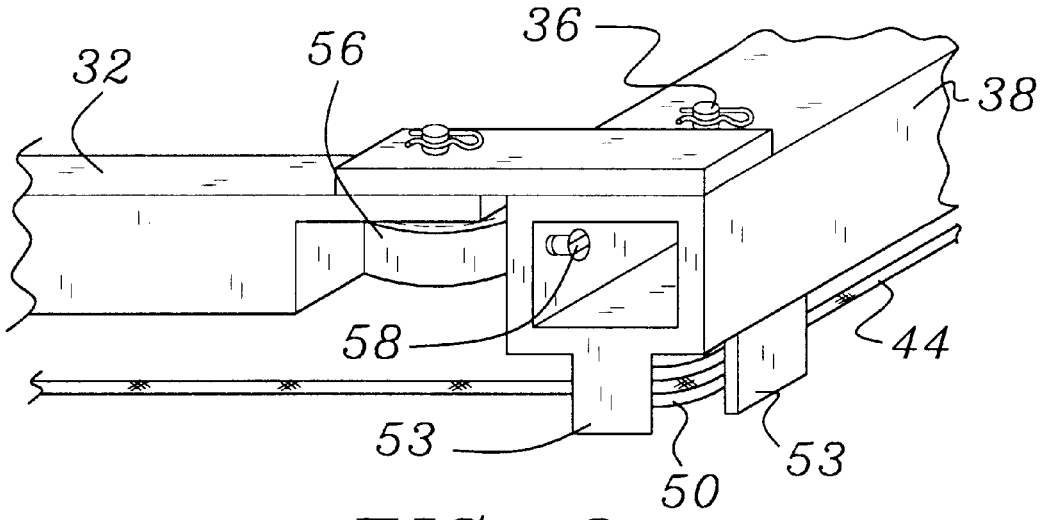
FIG. 3 is a detailed elevational view of a preferred arrangement for attaching a cross-bar to a longitudinal arm, the detail indicated by 3 in FIG. 1.
Figure 6:
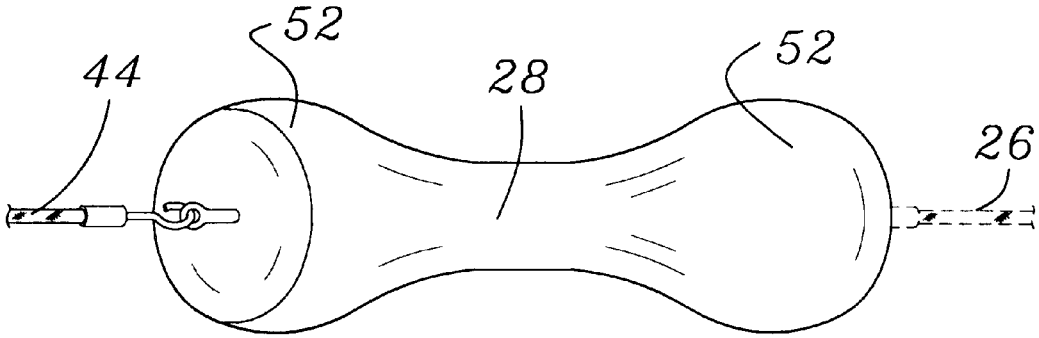
FIG. 6 is a detailed elevational view of a handgrip portion of the invention, the detail indicated by 6 in FIG. 1.
Figure 4:
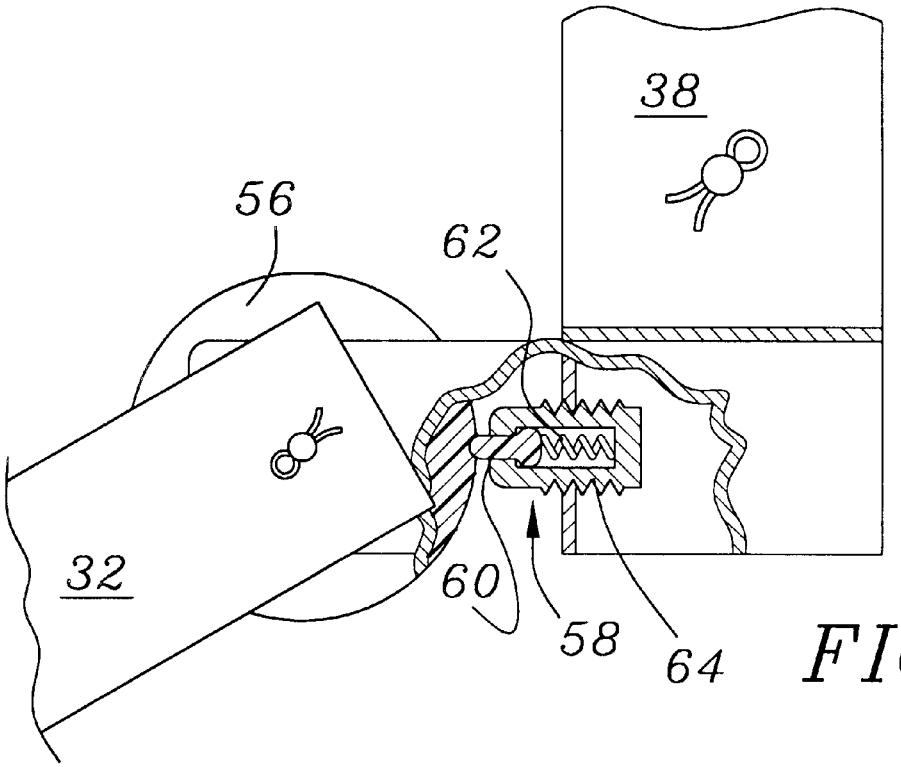
FIG. 4 is a partly cut away plan view of the detail shown in FIG. 3.

In a preferred embodiment the spooled rope or ropes 26 of the skiing-simulative equipment are extended by attaching an extension rope 44 between the two handles 28 so as to form a closed loop of rope or the mechanical equivalent thereof. The extension rope 44 extends from a first one of the handles 28 to a respective one of two rear pulleys 46 attached for rotation about a horizontal axis adjacent a rear end 48 of one of the longitudinal arms 32. The extension rope 44 passes around the respective rear pulley 46 and thence extends to a respective front pulley 50 that preferably rotates about a vertical axis 36. From there, the rope 44 passes around the other of the two front pulleys 50 to the second of the two rear pulleys 46 and thence to the other of the two handles 28. As depicted in FIGS. 2 and 3, the preferred pulley arrangement employs a pair of cord guides 53 at each pulley to keep the cord 44 in the pulley grooves whenever the cord 44 is slack (e.g., when the arm 32 is swung sideways to allow a user to mount or dismount from the apparatus.

It is desirable to keep the longitudinal arms 32 in their operating positions, but to also allow the arms to be swung out of that position without requiring the user to operate a separate manual latch. In a preferred embodiment a means of doing this is provided by a resilient idler wheel 56 and a spring detent 58 comprising a captive piston 60 and a bias spring 62 retained within a threaded housing 64. This arrangement is similar to one commonly used in controlling the motion of automobile doors.

Although a preferred embodiment employs two front pulleys 50 and two rear pulleys 46, other arrangement could also be used. These arrangements (not shown) include having a single front pulley, or having three or more front pulleys. Moreover, if the spring detent 58 arrangement discussed supra is not employed, it would be possible to hinge the longitudinal arm 32 about the axis 36 of the horizontal pulley 50 and to do without the additional tab 66 that is welded onto each of the outboard ends of the crossbar 38 in the preferred embodiment. It will be recognized that various other arrangements employing idler or tensioning pulleys could be employed. What is important to the invention is that a closed rope loop, or mechanical equivalent thereof, is formed. This loop is folded back upon itself, or otherwise indented in such a way that an exerciser can stand within the indented or inwardly extending portion of the loop without having it touch his or her legs or torso and can move his or her arms back and forth while holding on to portions of the rope.

Figure 5:
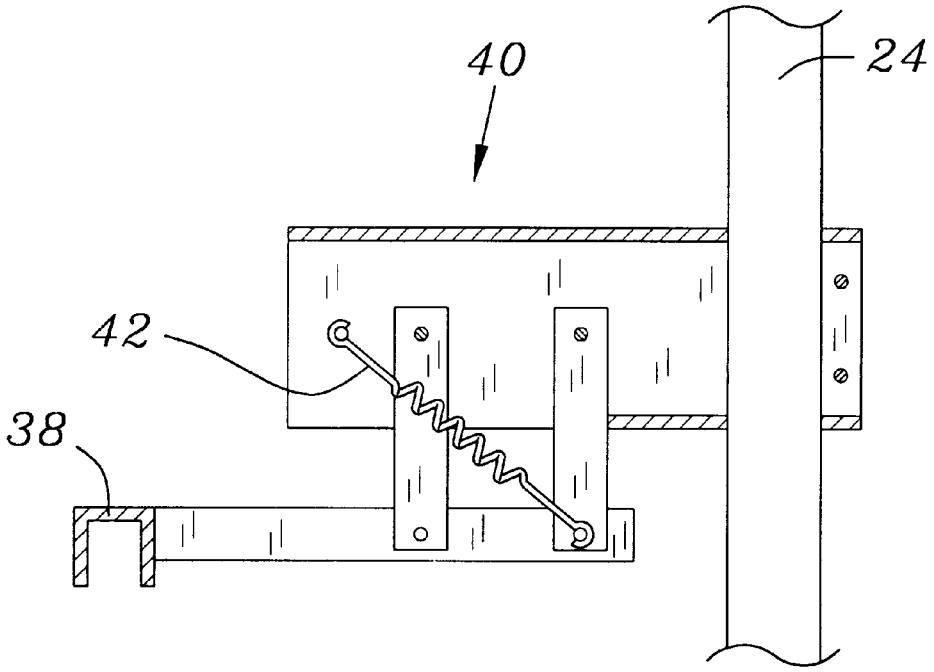
FIG. 5 is a detailed cross-sectional view of a mounting bracket portion of the invention, the section indicated by 5—5 in FIG. 1.

Although the foregoing discussion of adding features to an existing machine has been in terms of simply attaching an extension portion of rope or cable 44 to the ends of a spooled rope 26, it is expected that other approaches, such as supplying a single pre-fabricated rope loop, may be employed. Moreover, it is expected that in some cases the configuration of the handgrip or handle 28 will be changed. In many versions of the conventional ski treadmill 12, a handgrip 28 is used that has a tubular body with a single expanded end portion 52, which is adequate to prevent an exerciser's hand from sliding off the grip when pulling on the rope 26. In the improved apparatus of the invention 10, it is preferred to provide a handgrip 28 adapted to prevent the exerciser's hand from slipping off it regardless of which direction the rope 44 is being pulled. Thus, a preferred handgrip 28, as depicted in FIG. 5, has expanded end portions 52 on both ends.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. In a skiing-simulative exercise apparatus comprising a foot trolley arranged for back and forth motion along a track; an upstanding post disposed adjacent a front end of the track; and a pair of handgrips, each of the handgrips attached by flexible attachment means to a resistance generating means disposed forwardly of the post, the resistance generating means providing a resistance when either handgrip is pulled rearwardly by an exerciser, an improvement comprising a pair of horizontal arms extending rearwardly of an upper portion of an upstanding post, each of the arms having a respective forward end proximal to the post and a respective rearward end distal from the post;

first and second pulleys, each of the first and second pulleys mounted for rotary motion about a respective axis adjacent the rearward end of a respective arm;

a third pulley adjacent the forward end of the one of the arms and flexible connecting means extending from a first of the two handgrips to that one of the pulleys adjacent the rearward end of the first of the pair of arms; thence to the third pulley, thence to that one of the pulleys adjacent the rearward end of the second of the arms, and thence to the second of the two handgrips.

2. The exercise apparatus of claim 1 wherein the resistance generating means comprises a braked spool and the flexible attachment means comprises two spooled ropes, each of the ropes extending from the braked spool to a respective one of the handgrips.

3. The exercise apparatus of claim 2 wherein the flexible connecting means comprises a portion of rope.

4. The exercise apparatus of claim 1 further comprising a horizontal beam having two ends, the horizontal beam attached to the post and disposed transverse to the track, wherein each of the pair of horizontal arms is pivotally attached adjacent a respective end of the horizontal beam.

5. The exercise apparatus of claim 4 wherein the third pulley is disposed adjacent one end of the horizontal beam, the apparatus further comprising a fourth pulley disposed adjacent the second end of the horizontal beam.

6. The exercise apparatus of claim 4 wherein one of the rearwardly extending arms is attached to the horizontal beam by means comprising a spring detent.

7. The exercise apparatus of claim 4 wherein the horizontal beam is attached to the post by means comprising a bias spring urging the horizontal beam rearwardly from the post.

8. Exercise apparatus adapted to resist both a forward and a rearward swinging motion of an arm of an exerciser adjacent the apparatus, the apparatus characterized by:

a pair of handgrips, each handgrip attached by flexible attachment means to a braked spool disposed further forward of the exerciser than a maximum forward extent of the exerciser's arm motion;

first and second pulleys, each disposed rearwardly of a maximum rearward extent of the exerciser's arm motion, each of the first and second pulleys disposed on a respective side of the exerciser; wherein the first and second pulleys are attached to respective rear ends of horizontal arms, each of the arms having a respective forward end attached to an upper portion of an upstanding post; and a third pulley disposed in front of the exerciser;

wherein a portion of the flexible attachment means extends from a first of the handgrips to the first pulley, thence to the third pulley, thence to the second pulley and thence to the second of the handgrips.

9. The exercise apparatus of claim 8 wherein the third pulley is attached adjacent a first end of a transversely extending horizontal beam having two ends, wherein the apparatus further comprises a fourth pulley is attached adjacent the second end of the horizontal beam, and wherein the flexible attachment means engages the fourth pulley intermediate the third and the second pulleys.

* * * * *